US012735889B2

(12) United States Patent
Garcia Rojo

(10) Patent No.: US 12,735,889 B2
(45) Date of Patent: Sep. 15, 2026

(54) STRUCTURAL SYSTEM FOR BUILDING AND CIVIL ENGINEERING WORKS AND CONSTRUCTION METHOD

(71) Applicant: Miguel Garcia Rojo, San Sebastian (Guipuzcoa) (ES)

(72) Inventor: Miguel Garcia Rojo, San Sebastian (Guipuzcoa) (ES)

( * ) Notice: Subject to any disclaimer, the term of this patent is extended or adjusted under 35 U.S.C. 154(b) by 0 days.

(21) Appl. No.: 19/249,302

(22) Filed: Jun. 25, 2025

(65) Prior Publication Data

US 2025/0389116 A1 Dec. 25, 2025

(30) Foreign Application Priority Data

Jun. 25, 2024 (ES) ..... P202430524

(51) Int. Cl.
*E04B 5/36* (2006.01)
*E01D 12/00* (2006.01)
(Continued)

(52) U.S. Cl.
CPC ..... *E04B 5/36* (2013.01); *E01D 12/00* (2013.01); *E21D 11/107* (2013.01); *E01D 2101/268* (2013.01); *E04B 2103/02* (2013.01)

(58) Field of Classification Search
CPC ..... E04B 5/36; E04B 2103/02; E04B 5/28; E04B 5/19; E04B 5/21; E04B 5/266;
(Continued)

(56) References Cited

U.S. PATENT DOCUMENTS 5,527,128 A * 6/1996 Rope ..... E01C 5/20 428/44
6,170,105 B1 1/2001 Doyle et al.
(Continued)

FOREIGN PATENT DOCUMENTS

CN 112360028 A 2/2021
CN 115306025 A 11/2022
(Continued)

OTHER PUBLICATIONS

Spanish Search Report for Corresponding Spanish Patent Application No. 202430524, Feb. 6, 2025, 4 pages.

*Primary Examiner* — Patrick J Maestri
(74) *Attorney, Agent, or Firm* — LUCAS & MERCANTI, LLP

(57) ABSTRACT

A two-way structural system for construction, comprising a base part (1) with a plurality of longitudinal channels (1.1) and a plurality of transverse channels (1.2) that are evenly 5 distributed, a stiffening part (2) with a plurality of holes (2.3) along the sheets (2.1, 2.2); wherein both parts (1 and 2) are made of FRP material, and wherein the stiffening part (2), in an operational position, is connected by resting on the base part (1) and fitting into the corresponding channels (1.1, 1.2), defining a cavity in the channels (1.1, 1.2) between both parts (1, 2) to be filled with fibre-reinforced concrete, the assembly forming an integral structure once the concrete has set, and both parts (1.1, 1.2) being configured as a self-supporting structure against the pouring of the concrete. A building method for constructing bridges, tunnels and underground works, with the two-way structural system.

14 Claims, 8 Drawing Sheets

(51) Int. Cl.
*E21D 11/10* (2006.01)
*E01D 101/26* (2006.01)

(58) Field of Classification Search
CPC ... E04B 5/026; E04B 5/14; E04B 5/17; E04B 5/43; E01D 12/00; E21D 11/107; E04C 3/28
See application file for complete search history.

(56) References Cited

U.S. PATENT DOCUMENTS

| | | | | |
|---|---|---|---|---|
| 6,189,289 | B1 * | 2/2001 | Quaglia | E04F 15/024 52/220.1 |
| 6,427,395 | B1 * | 8/2002 | Elsasser | E04F 15/10 428/167 |
| 6,591,567 | B2 | 7/2003 | Hota et al. | |
| 7,743,446 | B2 | 6/2010 | Collins | |
| 2005/0202225 | A1 | 9/2005 | Richards | |
| 2006/0075707 | A1 * | 4/2006 | Cretti | E04B 5/04 52/414 |
| 2007/0214740 | A1 * | 9/2007 | O'Grady | E04B 5/326 52/577 |
| 2008/0313990 | A1 * | 12/2008 | Cretti | E04B 5/36 52/745.19 |
| 2013/0239499 | A1 | 9/2013 | Caboni | |
| 2013/0276399 | A1 | 10/2013 | Rapaz | |

FOREIGN PATENT DOCUMENTS

| | | | |
|---|---|---|---|
| ES | 2514117 | A1 | 10/2014 |
| JP | 2009084908 | A | 4/2009 |
| KR | 100835901 | B1 | 6/2008 |

* cited by examiner

STRUCTURAL SYSTEM FOR BUILDING AND CIVIL ENGINEERING WORKS AND CONSTRUCTION METHOD

CROSS-REFERENCE TO RELATED APPLICATIONS

This application claims the benefit of priority from Spanish Application No. P202430524 filed on Jun. 25, 2024, the contents of which is incorporated herein by reference in its entirety.

TECHNICAL FIELD

The present invention relates to the sector of constructing building and civil engineering works structures, and more specifically, to a structural system without temporary support structures, using elements manufactured in resin matrix with fibres, which form a self-supporting assembly allowing the in situ addition of fibre concrete, providing monolithism and stiffness to the assembly.

BACKGROUND OF THE INVENTION

The most common systems currently used in building construction are reinforced and pre-stressed concrete slabs, consisting of concrete and passive steel elements in the first case, and adding active steel in the second case.

On the one hand, there are systems that are made on site, which can be, for example, one-way slabs, suitable for spans of up to 5 metres, or two-way waffle slabs, suitable for spans of between 5 and 12 metres, or a third option consisting of reinforced and pre-stressed floor slabs, suitable for spans of between 7 and 15 metres. This construction system requires the use of temporary support structures or falsework, which complicates construction and lengthens completion times, and sometimes involves duplicating the supporting structure, albeit temporarily. On the other hand, on-site processes require personnel specialised in implementation methods, and sometimes improvisation is necessary to solve problems on site, which also hinders construction and delays deadlines, thus impacting the quality of the finished product.

Furthermore, there are also precast concrete methods, which allow industrialisation of the process, with generally modular parts being made of reinforced or pre-stressed concrete. Another similar type is represented by composite slabs in which metal skeletons are built to support composite slabs of sheet metal deck and concreted floor slab in situ.

Other systems create complete box-like elements that include the building's installations, in the case of buildings; however, in order to lower costs, this ends up being detrimental to the functional quality of the assembly.

In addition, these prefabricated systems still have long construction times and very stiff structures in terms of design and conception to suit the construction site and the service needs of the structure.

With regard to civil engineering works, structures are classified in similar ways as to whether they are built in situ or prefabricated. There are different types depending on the type of structure. The main elements of a bridge are slab girders, lightened slabs and caissons. In tunnels, the sections are divided into support and lining, the former being mainly metallic and the latter having mass concrete and sometimes reinforced concrete. With regard to other types of structures such as walls, the sections are made of mass concrete or reinforced concrete, as appropriate. In the case of underpasses such as frames or gantries, the type is mainly reinforced concrete.

In any case, a mould or formwork is required to implement these in-situ construction methods. In the case of prefabricated structures, building them does not require falsework, except for some temporary support, although the joint between them to achieve additional properties in the structure can lead to connections that are highly complex and difficult to carry out.

On the other hand, document U.S. Pat. No. 6,170,105 discloses a building system with pultruded composite elements with closed section stiffeners. This solution also requires a metal support structure, and it is not a comprehensive solution as it is only suitable for short spans.

Document U.S. Pat. No. 7,743,446 discloses a system with a folded composite half-section, and when the sections are joined together, they form one-way ribs that allow concreting. Both materials are joined together in the concreting, however, once again this is a solution for short spans and a metal framework must be installed.

Document U.S. Pat. No. 6,591,567 discloses a fibre-reinforced polymer (FRP) module with a tongue-and-groove joint that is secured by adhesive or heat. It has one-way behaviour. It is neither a structural nor comprehensive solution, also requiring a support framework for its installation.

Document US20050202225 discloses linear FRP elements having an open half-section. When these elements are joined together, they form a one-way surface that allows concreting. This type of solution also relies on a conventional support structure.

In view of the described drawbacks or limitations of the existing solutions, a solution is needed that allows for quicker and simpler construction, while providing a comprehensive, self-supporting solution that does not require any additional support structure during construction.

DESCRIPTION OF THE INVENTION

In order to meet this objective and solve the technical problems discussed so far, in addition to providing additional advantages that may be derived later, the present invention provides a two-way structural system for construction, comprising:

- a panel-shaped base part with a plurality of longitudinal channels and a plurality of transverse channels that are evenly distributed;
- a stiffening part with a plurality of longitudinal sheets and a plurality of transverse sheets that are evenly distributed and joined together in the form of cross bars, and with a plurality of holes distributed along the sheets;
- wherein both parts are made of fibre-reinforced polymer (FRP) material, and wherein the stiffening part, in an operational position, is connected by resting on the base part and fitting into the corresponding channels, defining a cavity in the channels between both parts that, once connected to be filled with fibre-reinforced concrete through the plurality of holes, form a monolithic assembly once the concrete has set, and both parts being configured to form a self-supporting structure that is reinforced and becomes stiffer when the subsequently poured concrete is set.

It is envisaged that FRP can be manufactured with different types of resin and fibre, or fibre prepregs. These resins and fibres are selected according to all the design parameters of the structure and they can be artificial, natural, recycled or mixed resins. These parts will therefore be mouldable to any shape, improving the quality of the final product as it is manufactured in a controlled environment. Furthermore, it allows on-site modification for adaptation and troubleshooting, it is highly resistant to chemical attack and the maintenance required for the structure is minimised to almost zero.

Likewise, during their configuration the parts are manufactured taking into account the necessary properties for their assembly and self-supporting nature in construction, in addition to the properties provided once they are bonded to the concrete. In this way, internal resistance is provided to the final structure assembly, which makes it possible to eliminate the general reinforcement used in the systems known in the state of the art, dispensing with falsework, except in some cases in which specific reinforcement on passive or active steel FRP bars may be required, depending on the stresses and based on the needs of the structure.

This configuration also provides a waffle slab with strength and stiffness in both directions, generally orthogonal, and a greater resistance to crack propagation and spalling compared to standard concrete slabs, as well as a high fatigue resistance.

Both the base part and the stiffening part are easy to handle, even manually, and are preferably dimensioned according to the maximum dimensions established by traffic regulations. For this purpose, it is also envisaged that the base part comprises lightening elements, preferably having a quadrangular shape.

In addition, due to its configuration, the base part is flexible, which makes it even easier to handle on site. This base part does not have continuity of compressive or tensile stresses in the upper area and between ribs, nor does it have shear stresses between ribs. The compression or traction of the upper area is reduced by gradient and becomes a shear stress as it moves closer to the support points, which is why the stiffening part acts as a transition of said forces, serving as a continuity at the rib crossings. As explained above, the stiffening part supports the compressions or tractions and the shear transfer during concreting and, on the other hand, it stiffens the part in a temporary situation, reducing the deflections during construction.

The base parts can be prefabricated and transported to the site, allowing FRP manufacturing methods such as hand lay-up, spray lay-up, vacuum bagging or vacuum infusion, resin transfer mould (RTM), or other similar methods that allow the use of EPS, XPS and Polyurethane moulds and the like.

According to an alternative embodiment, the base parts can be manufactured in situ at the site so that it is possible to place lightweight moulds on site, joining them together and making the FRP base part according to the methods described above to form a monolithic FRP base part. This mould may be removed and reused. In its implementation, this system does not present a controlled atmosphere with difficult curing of the resin, but it can be useful in repair works of structures or even small repairs of the prefabricated system once it has been placed on site.

Another advantage of this system is that it allows finishes of any kind, e.g., colour, texture, etc., with the simple addition of additives to the resin mixture during FRP manufacture. Similarly, additives will be added to provide the structure with any requirements such as compliance with regulations regarding fire resistance, fatigue or any other effect required under the particular service conditions.

According to another feature of the invention, the channels of the base part are V-shaped and have a cross-section in the upper part thereof configured to fit the stiffening part with pins having a complementary geometry of the sheets of said stiffening part.

Preferably, said upper section is an end with a straight cross-section, which corresponds to the depth dimensions of the pins of the sheets of the stiffening part.

The "V" shape is the preferred but non-limiting shape, but it may also be a "U", "W", or "Z" shape, provided that there is a fit between the base part and the stiffening part for filling with fibre concrete.

This configuration improves the mass/stiffness ratio and thus controls the vibration of the structure, further providing adequate bending stiffness for deflection and high shear strength.

According to another feature of the invention, the stiffening part and the base part are connected by means of mechanical and/or adhesive fastening means. Thus, the joint may be made by fitting, reinforcing said joint, or simply forming a joint, for example, by means of self-drilling screws and/or by gluing prior to installation.

Preferably, the invention also envisages that the base part and the stiffening part are manufactured in one piece, where the base part has to surround the stiffening part for complete homogenisation and correct transfer of the stresses. In this case, it could be done by means of a mould that can later disintegrate and the joint part can be made by infusion, or by hand lay-up or spray lay-up, inserting the stiffening part once the base part has been formed, leaving fibres that make it possible to surround the stiffening part, overlapping it properly.

Preferably, according to the invention, the holes in the stiffening part for pouring concrete are rounded, preferably circumferences, although other options such as elongated through holes are also envisaged. This avoids angulations that concentrate stress peaks. Preferably, concrete access will be from the vertical.

According to another feature of the invention, the structural system comprises clip-on anchoring means for fastening between the side ends of a base part and the side ends of an adjacent base part. These elements can be reinforced with mechanical or adhesive systems to provide the joint with more demanding mechanical properties depending on the needs for using the structure.

Thus, the system can have several modules that can be coupled together with a continuity of stress resistance and deformation stiffness. In this way, an industrialised modular arrangement can be provided. This arrangement also allows subsequent phases to be built without having to complete the previous phase as it is self-supporting.

Preferably, the stiffening part comprises fastening means at its side ends for fastening a stiffening part to another adjacent stiffening part in order to join them by fitting such that said fastening means are fastened in the holes in both stiffening parts, and/or comprises fastening braces that can be anchored between both adjacent stiffening parts that are fastened in corresponding holes.

Preferably, the parts of the structural system also have a configuration with a predefined shape depending on the construction for which they are intended. Thus, for example, the parts can have an arched shape for constructing bridges, tunnels or underground works.

According to another feature of the invention, the system comprises a primer or roughness on the base part for better adhesion of the concrete. There may also be chemical aids such as a bonding bridge between FRP and concrete, being applied, for example, by roller, brush or spray to improve adhesion between the two materials.

Preferably, the system comprises moulds for the manufacture of the base part. Said moulds are suitable for manufacturing FRP parts to which acoustic insulation, thermal insulation and/or fire resistance properties can be applied, so that it is integrated with the assembly of the structural system in the form of a plate.

According to another aspect, the invention relates to a construction method comprising the following steps:

- arranging an enclosure as a foundation mould comprising an inner part in FRP, and a central prismatic element for connecting a pillar of the building to be built, and filling with fibre-reinforced concrete to form each of the foundation elements,
- constructing the slab according to the following steps:
  - arranging a capital on a pillar made of FRP with openings at the bottom thereof in the connection area with the pillars for the passage of concrete and the connection element with the next pillar, and then proceeding with the joint concreting of the capital and pillar with fibre-reinforced concrete,
  - placing the plate elements of the two-way structural system between capitals and then covering the gaps between the plates already in place with smaller elements, according to any one of the features described above, and after fastening perimeter closing slab girders to the plates, and placing any additional reinforcement required, pouring fibre-reinforced concrete to form the final slab,
- repeating the slab construction process according to the number of floors in the building.

This method reduces construction times by eliminating the need to place a large amount of reinforcements, and also increases construction safety as the parts are easy to handle, making it easier to implement a site assembly plan.

According to another aspect, the invention relates to a method for constructing bridges that comprises arranging a structural system as described above, with curved modules and flat modules suitable for the shape of the bridge to be built, and joining said modules with fastening means and anchoring means and/or fastening braces, so that a main flat module of the structural system is joined at the starting points of curvature of the bridge, placing the necessary additional reinforcements and subsequently pouring the fibre concrete until it sets, forming the integral assembly of a bridge.

According to a final aspect, the invention relates to a method for constructing tunnels and underground works that comprises arranging a structural system as described above, with modules having a geometry of constant curvature, variable curvature or a polygonal succession which, after connection thereof by fastening means and anchoring means, form a geometric configuration of variable curvature or polygonal sequence, placing the necessary additional reinforcements and subsequently pouring the fibre concrete until it sets, forming the integral assembly of a tunnel or underground work.

PREFERRED EMBODIMENT OF THE INVENTION

In light of the aforementioned figures, and in accordance with the adopted numbering, one may observe therein a preferred exemplary embodiment of the invention, which comprises the parts and elements indicated and described in detail below.

Figure 1:
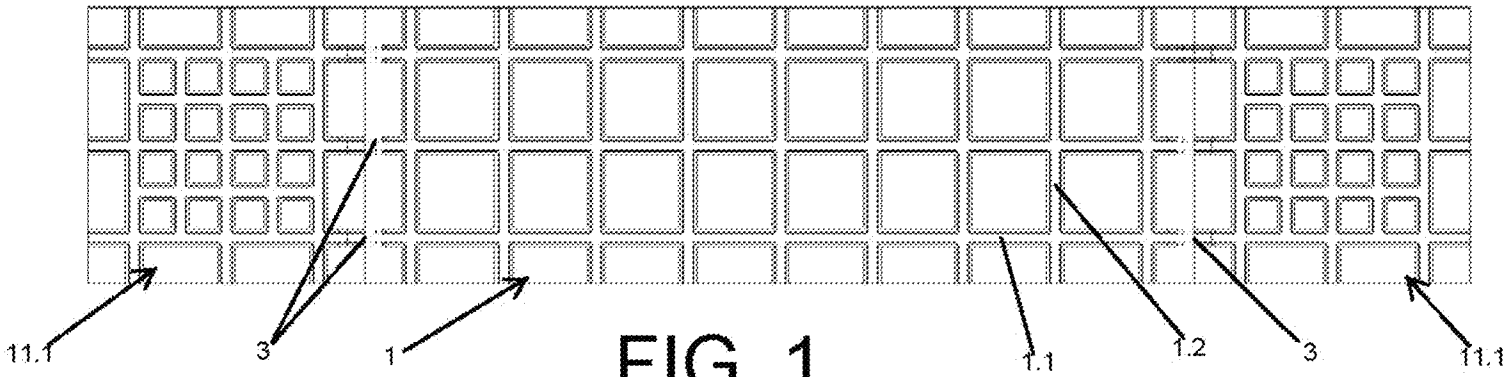
FIG. 1 shows a top view of a base part (1) of the structural system of the invention, joined at each end to a base part (12) having a capital, for forming a slab.

FIG. 1 shows a base part (1), in this case for modular construction, i.e., forming different plates of the structural system for the construction. At its side ends, said base part (1) comprises anchoring means (3) for retention, which can be better viewed in FIG. 6, and which determine its connection to adjacent base parts, in this case for its connection to a capital base part (11.1). These parts (1, 11.1) are prefabricated and transported to the site, being easy to handle for installation. Nevertheless, it is envisaged that there may be a prefabricated mould with pre-determined dimensions, so that the base part (1) can be formed by moulding FRP on site, for example, for refurbishment work. In this case, the mould may have acoustic insulation, thermal insulation and/or fire resistance properties, so that the mould is arranged in such a way that it is integral with the assembly. This base part (1) comprises a plurality of longitudinal channels (1.1) and a plurality of transverse channels (1.2) that form a framework which will define the two-way quality of the slab once the concrete placed in said channels has set.

Figure 2:
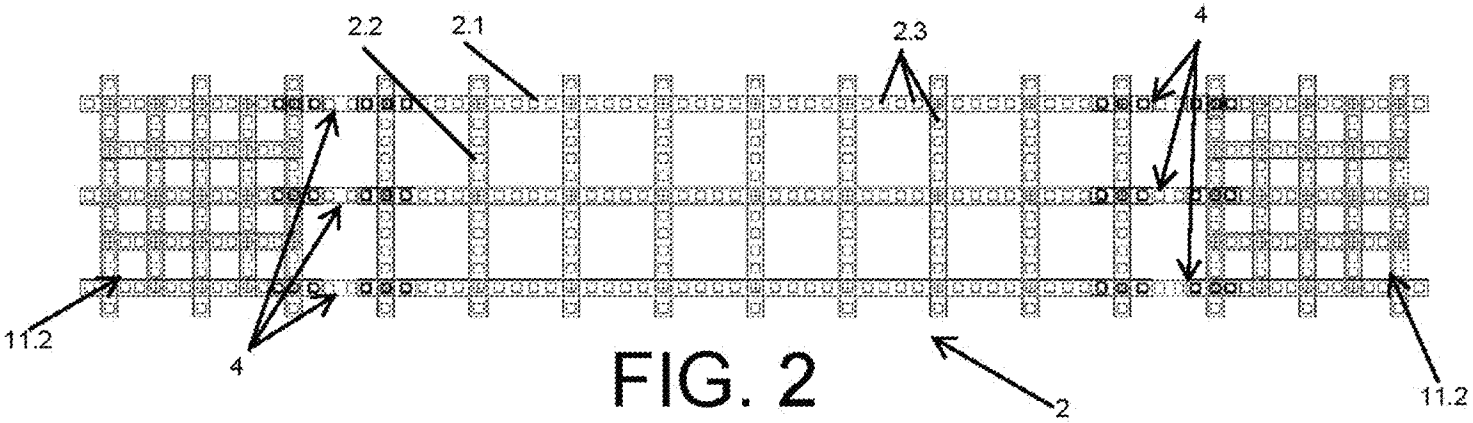
FIG. 2 shows a top view of a stiffening part (2) of the structural system of the invention, joined at each end to a stiffening part (13) having a capital, for forming a slab.

FIG. 2 shows a stiffening part (2), with dimensioning corresponding to the base part (1), and a capital stiffening part (11.2), which are joined by fastening means (4). This stiffening part (2) comprises a plurality of longitudinal and transverse sheets (2.1, 2.2) with a cross bar-shaped configuration corresponding to the channels (1.1, 1.2) of the base part (1). Said sheets (2.1, 2.2) have a distribution of holes (2.3) for pouring concrete.

Figure 3:
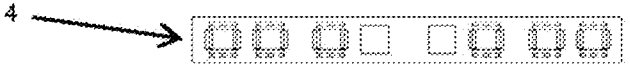
FIG. 3 shows a top view of fastening means for fastening a stiffening part to an adjacent stiffening part.
Figure 4:
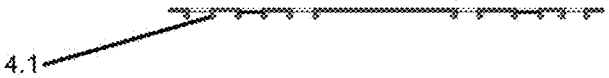
FIG. 4 shows a profile view of the fastening means of FIG. 3.

FIG. 3 shows said fastening means (4) in the form of a connecting clip, where its clip-on configuration is shown in FIG. 4 in a profile section, for fastening in the holes (2.3) and for fastening the stiffening part (2) to an adjacent one, in the practical case of FIG. 2 for fastening to a capital stiffening part (11.2). The clip fastening is achieved by means of the fastening pins (4.1) that are inserted and fastened in the holes (2.3) and therefore have a corresponding geometry.

Figure 6:
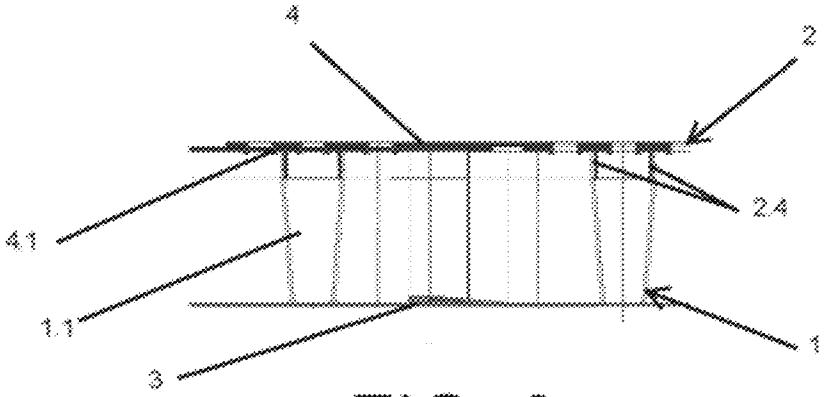
FIG. 6 shows a detail view of the fastening of the anchoring means between two adjacent base parts, and the fastening means of FIG. 3 between two adjacent stiffening parts.

Thus, as can be seen in the detail of FIG. 6, the fastening means (4) and/or the anchoring means (3) are used to join parts of modules of the structural system of the invention. This figure shows how the anchoring means (3) are in the form of a fastening step with a retaining clip on the lower part of the base part (1), corresponding to a complementary step of the capital base part (11.1). This section shows the geometry of the V-shaped cross-section of the base part (1), and how the stiffening part (2) has fitting pins (2.4) corresponding to the straight upper cross-section of the base part (1). These fitting pins (2.4) perform the function of shear transfer between channel crossings (1.1, 1.2) of the two-way parts. Complementing said fit are the fastening means (4) which, as shown in FIGS. 3 and 4, have the shape of a connecting clip with clip-on fastening fittings in the holes (2.3) in the stiffening part (2), thus achieving strong fastening before concreting which ensures the continuity of the structure for the distribution of forces.

Figure 5:
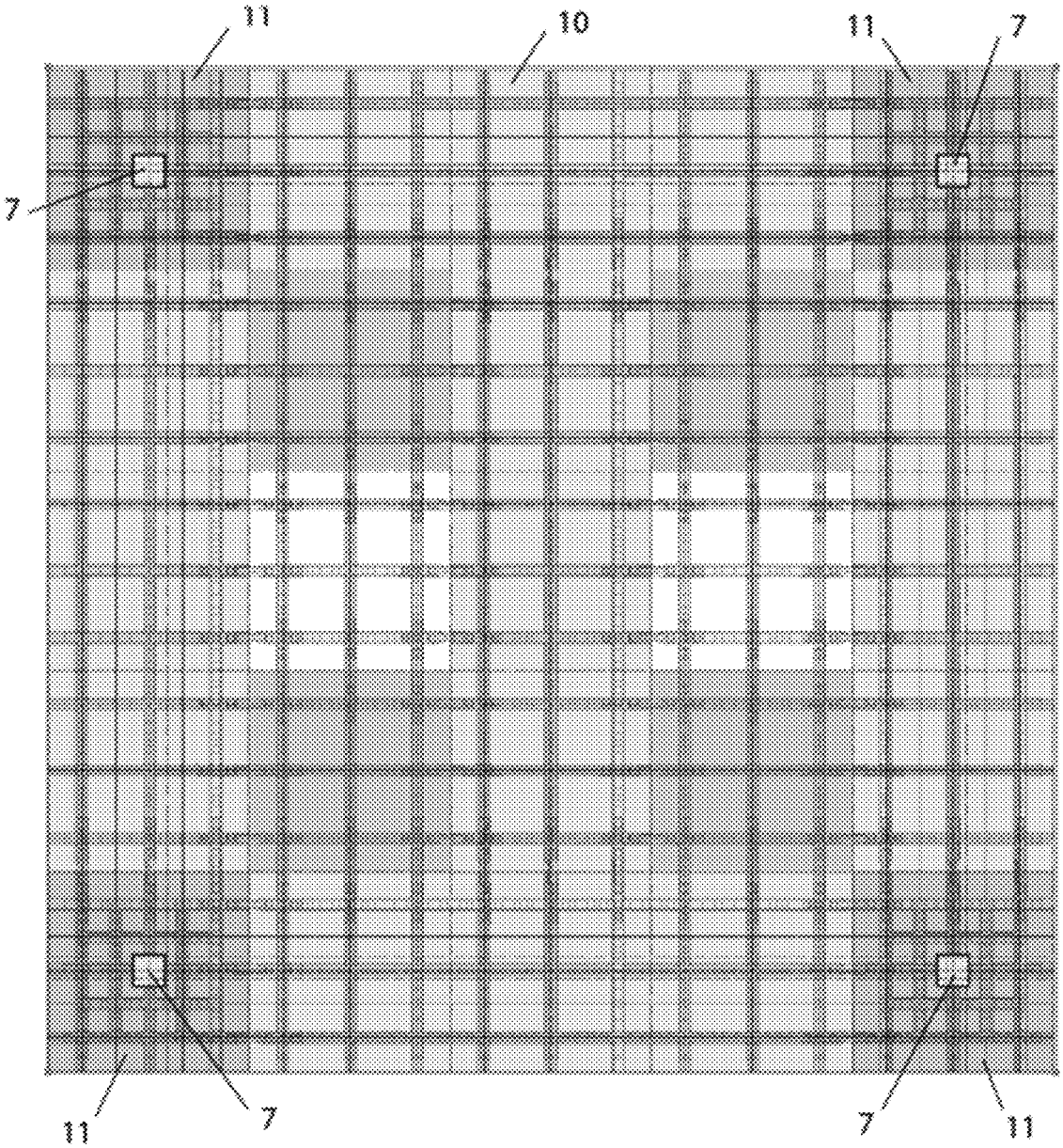
FIG. 5 shows a top view of a structural system of the invention for forming a slab.

FIG. 5 shows a practical example of the structural system of the invention for a practical embodiment of a slab, wherein the joining of different modules can be seen, with parts (1, 2) for long spans and reduced spans.

The geometry of the system is governed by the usual relationships in two-way slabs. As a practical example, the depth-to-span ratio is greater than 1/22.5. The width of the ribs is greater than one quarter of the depth of the arranged FRP, which depends on the depth of the in-situ compression slab (concrete on FRP). The compression slab has values from around 50 to 70 mm depending on the structural requirements. The distance between ribs is determined by the thickness of the compression slab which thickness will be 1/10 of the calculation span between ribs, and this is the result of subtracting the width of a rib and a depth of the compression slab on each side of the free span between rib axes.

For example, for a slab with 10m spacing between pillars (7), the total depth is 455 mm with 400 mm of FRP and 55 mm of compression slab. The ribs have a bottom width of 100 mm and a top width of 150 mm spaced 800 mm apart. The thickness of the FRP is a function of the stresses to be supported by the slab. The amount of concrete is around 0.15 $m^3/m^2$, less than the current 0.19 to 0.24 $m^3/m^2$. The deformations of the system require a counter deflection of approximately 20 mm in the FRP to comply with the regulatory requirements for all the most common load cases. The creep of the structure is taken into account in the verification.

Thus, depending on the requirements of the building, a module distribution suited to the corresponding dimensioning is designed, which, as can be seen in the practical example in FIG. 5, comprises two side long modules, an upper long module, a lower long module, and another central long module, with smaller connecting modules, and with capital modules corresponding to the pillars. Once all the modules with their base parts (1) and the stiffening parts (2) have been placed, and once the joint between them has been secured with the joining elements, the fibre concrete is poured, forming a final monolithic slab assembly, as shown in FIG. 5.

Figure 7:
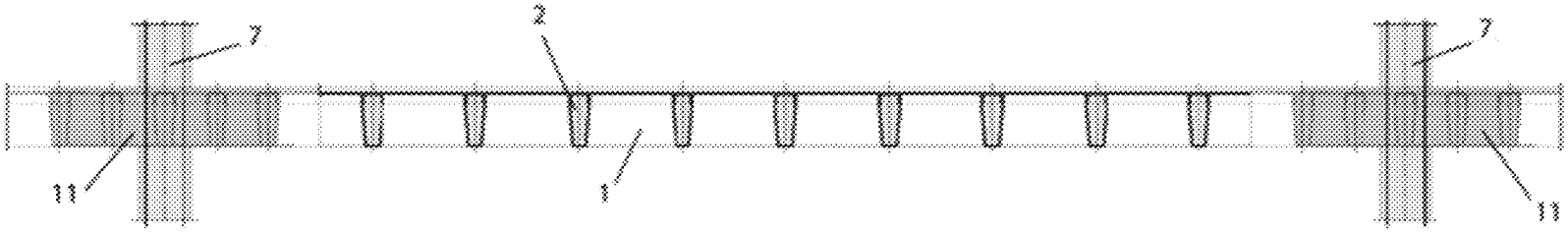
FIG. 7 shows a sectional profile view of the structural system of FIG. 6.

FIG. 7 shows a cross-section of the structural slab system assembly once the concrete has set. This shows how the capital modules (11) are joined to the pillar (7), and how the concrete forms a two-way structure by filling the channels (1.1, 1.2) and adding an upper compression layer of concrete according to the requirements of the construction, forming an integral assembly.

Figure 8:
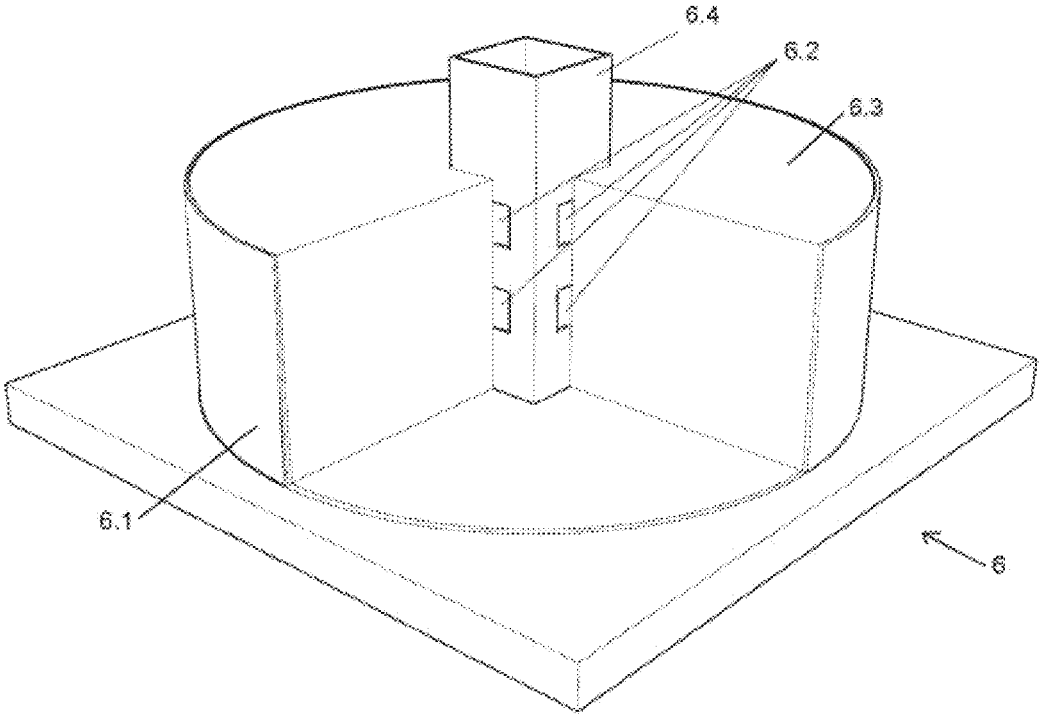
FIG. 8 shows an isometric view with cross section of a practical example of a foundation of the structural system of the invention.

According to a building method, the foundation elements (6) are first built. As can be seen in FIG. 8, said foundation element (6) rests directly on a base prepared and levelled by means of clean concrete or similar. To form said foundation (6), a container made of FRP is provided as a basin (6.1). As can be seen, in the central portion there is a central prismatic element (6.4) that will be used for the future insertion of the pillar (7) which will support the first floor of the building to be built. The element (6.1) has a series of openings (6.2) to allow the passage of the concrete subsequently poured. If necessary, reinforcing bars are provided for reinforcement. Once the additional reinforcement is in place, if necessary, filling with fibre concrete (6.3) is carried out. These fibres can make additional reinforcement unnecessary in certain load situations.

Figure 9:
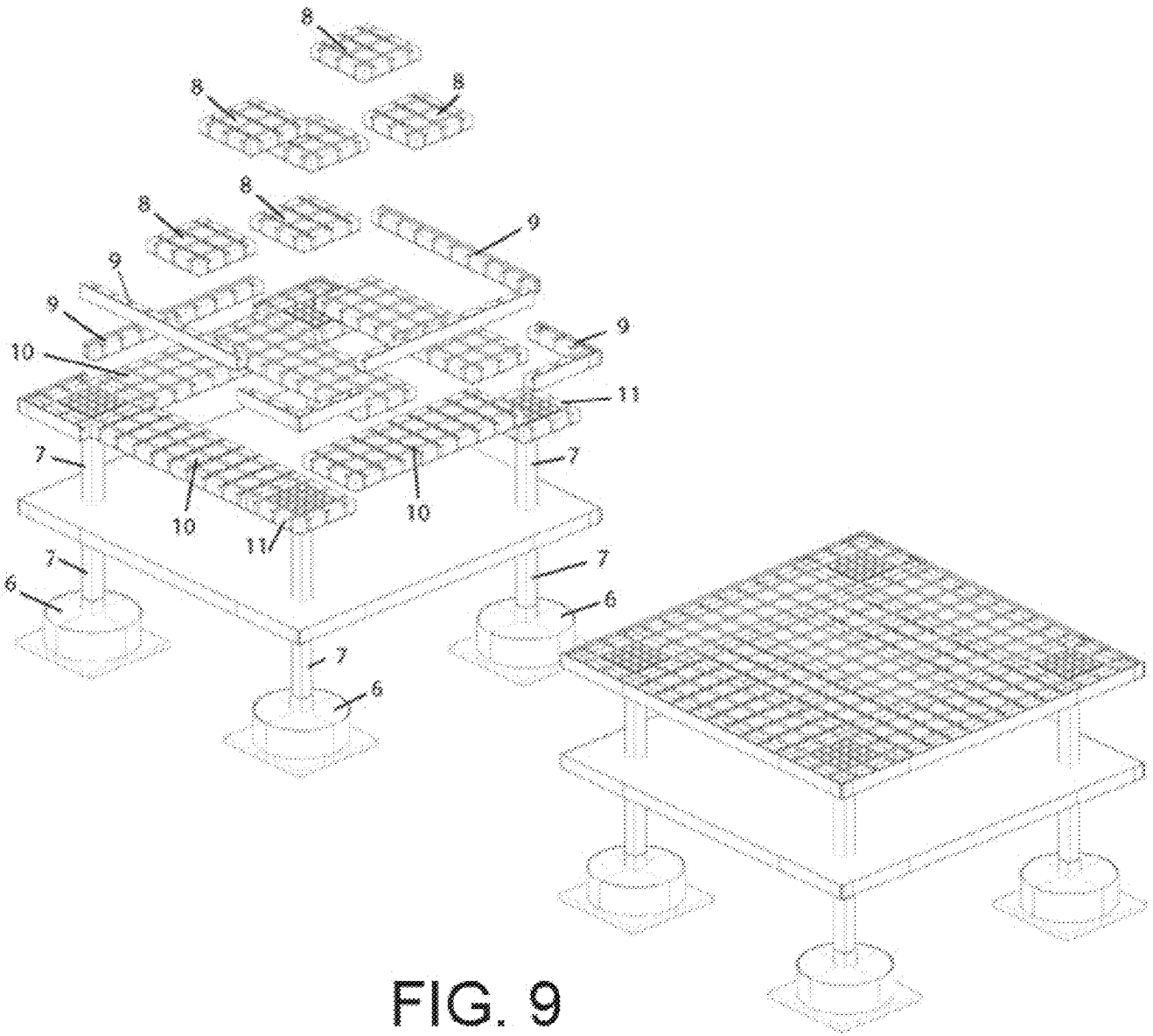
FIG. 9 shows a schematic view of a practical example of a building with the structural system of the invention.

Once the foundation is formed, the pillars are connected, after gluing the perimeter of the central prismatic element (6.4), and then the slab is built in connection with the pillars (7). To construct the slab, a capital (11) is placed on pillars (7) made of FRP with openings at the bottom thereof in the connection area with the pillars (7) for the passage of concrete, and the joint concreting of the capital (11) and pillar (7) with fibre-reinforced concrete is carried out. Once the pillars (7) and capital (11) have been formed, a two-way slab is built according to the structural system of the invention, defining a configuration as shown in FIG. 6. As can be seen in FIG. 9, once all the parts (8, 10) and the corresponding necessary additional structural reinforcements have been fastened, perimeter closing girders (9) are placed, and the fibre-reinforced concrete is poured to form the final slab. This process will be repeated for each of the floors in the building.

Figure 10:
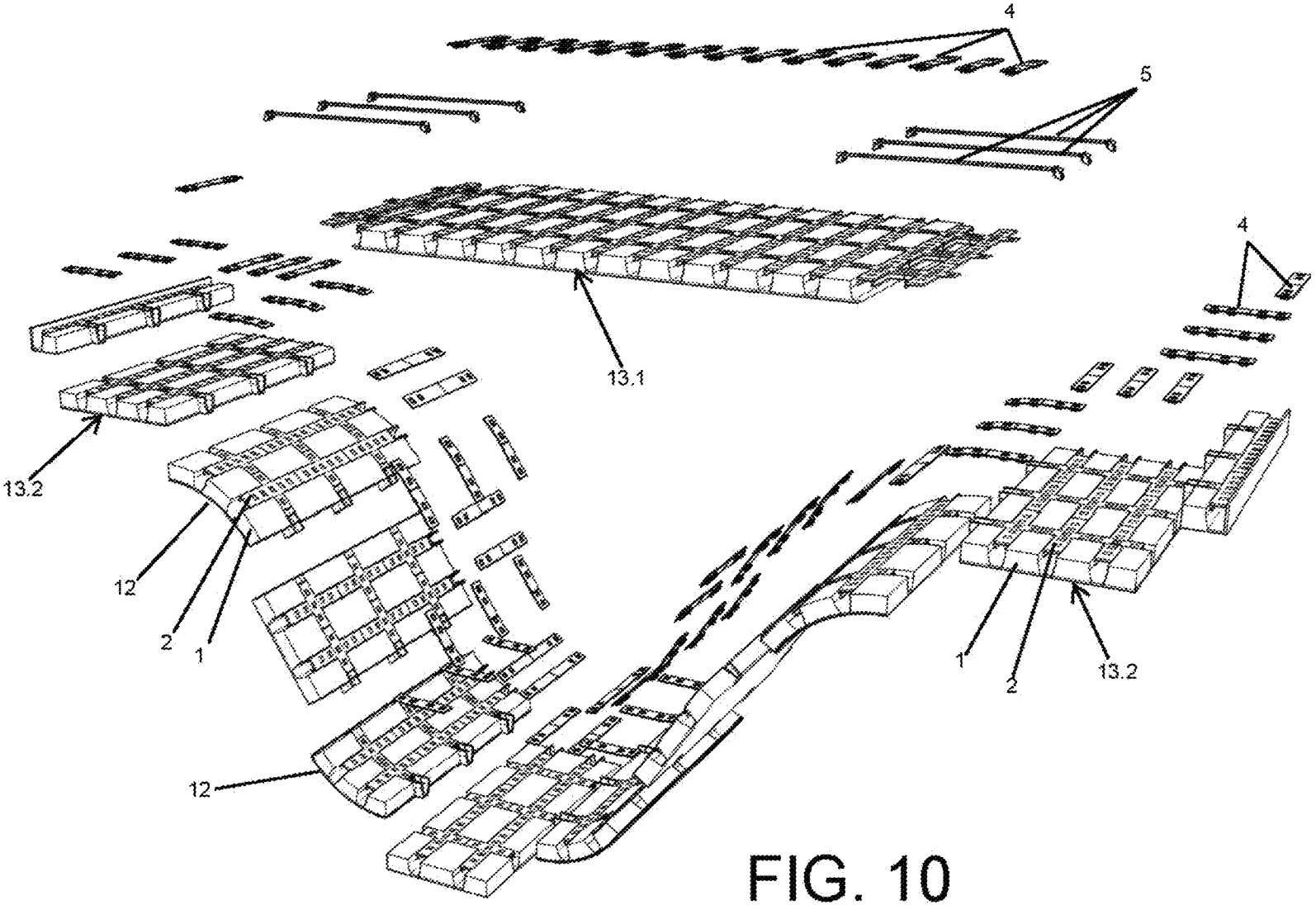
FIG. 10 shows an exploded view of the structural system of the invention for an embodiment of the shape of a bridge.
Figure 11:
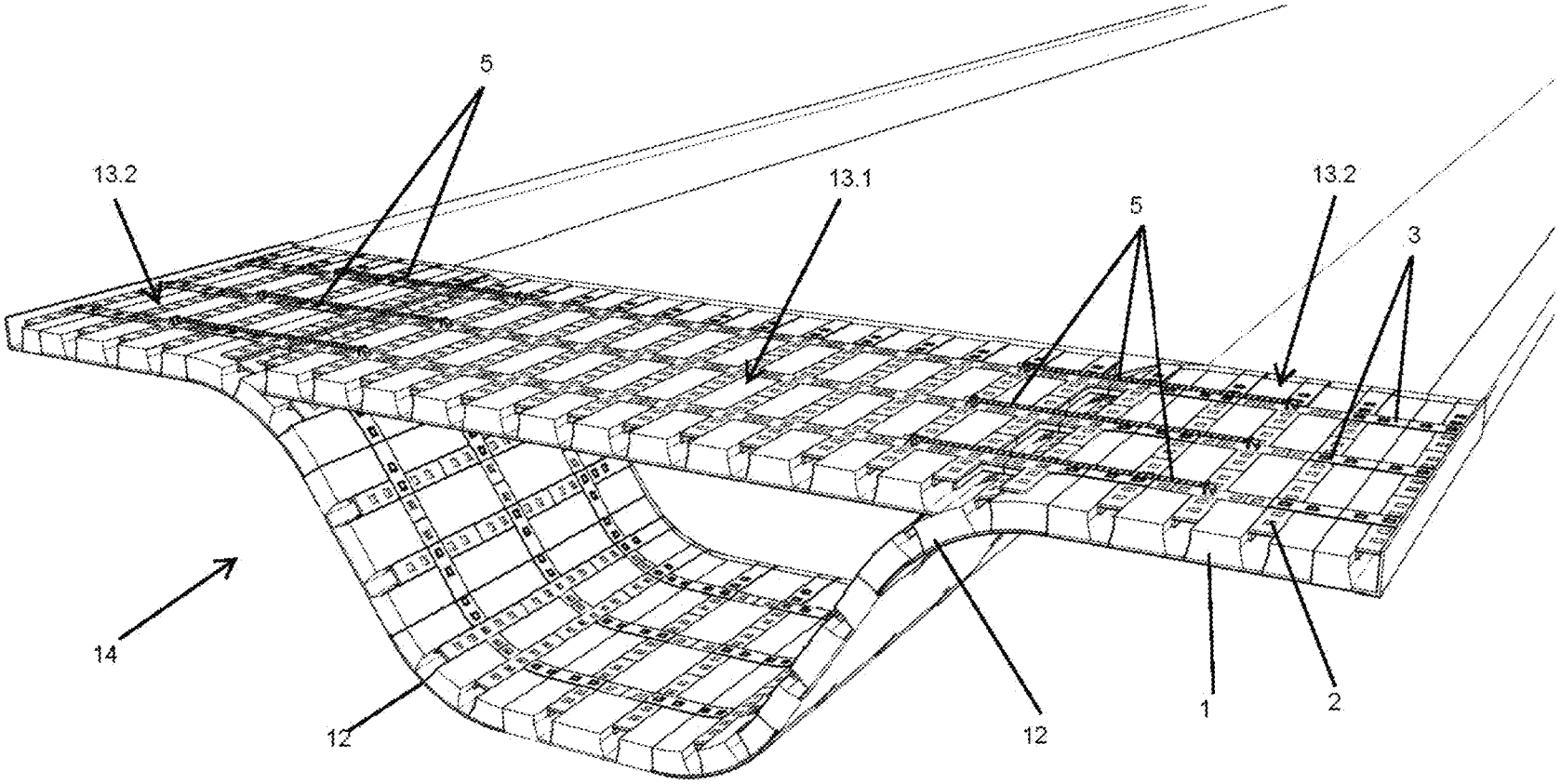
FIG. 11 shows an isometric view of the bridge of FIG. 10 assembled before pouring the fibre concrete.

FIG. 10 shows an alternative embodiment of the invention, for forming a bridge (14). As can be seen in this figure, there are base parts (1) and stiffening parts (2) with a predefined curved configuration based on the design requirements and forming curved modules (12), with a curved U-shaped reinforcement part that will be joined by the fastening means (4) to the elements of the previously built section. The overhangs of the future section (13.2) are anchored in the same way to the previously built structure. The central plate (13.1) is then positioned and joined to the respective end flat plates (13.2) of the previous formed element by the aforementioned fastening means (4). Once all the modules (13.1, 13.2, 12) have been joined together as shown in FIG. 11, fastening braces (5) are included at the most critical joints to support the stresses during concreting, as well as in the final situation. Given the channel configuration, it is possible to add any additional reinforcement required, either active or passive of any kind. Once the fibre concrete has set, the structure of the bridge (14) is formed. It is envisaged that bridges with spans of up to 20 m or 40 m can be made without the need for curved modules (12).

Figure 12:
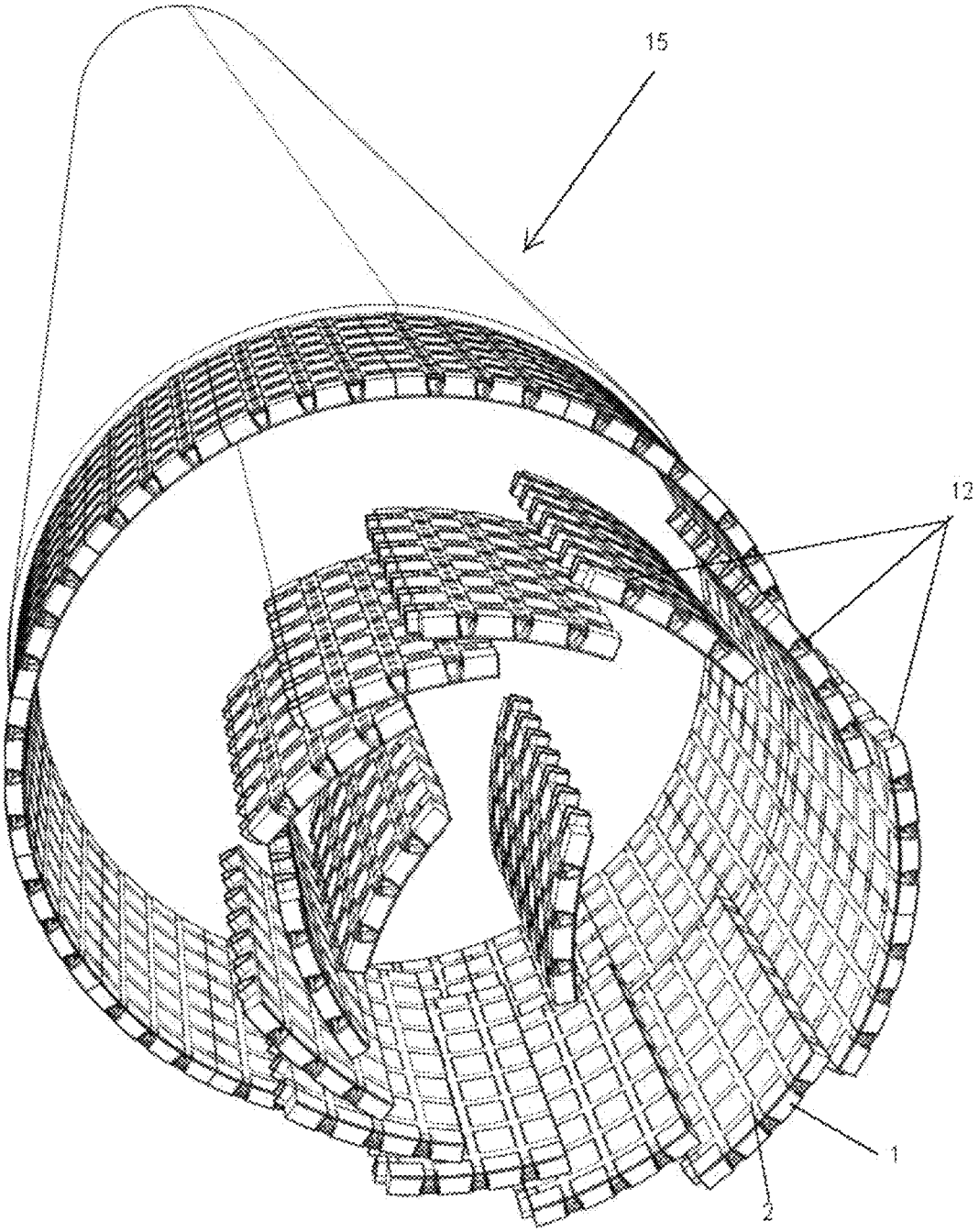
FIG. 12 shows an isometric view of the assembly of the structural system of the invention for an exemplary embodiment in the shape of a tunnel.

According to an alternative embodiment, as can be seen in FIG. 12, the structural system of the invention can be used in the construction of tunnels and underground works, joining base parts (1) and stiffening parts (2) with a curved shape and having a constant or variable curvature or polygonal succession, according to the geometric needs of the design of the tunnel or underground work to be built, and fastening them by fastening means (4) and anchoring means (3) which will define a similarly curved configuration for their fitting. Subsequently, once the parts (1, 2) have been arranged, the section between the FRP arranged and the natural ground must be concreted, thus forming a tunnel (15) with similar features to other construction methods, but greatly minimising completion times. Furthermore, as it is made of FRP, it will be more durable than the current steel systems.

The invention claimed is:

1. A two-way structural system for construction, comprising:

a panel-shaped base part (1) with a plurality of longitudinal channels (1.1) and a plurality of transverse channels (1.2) that are evenly distributed;

a stiffening part (2) with a plurality of longitudinal sheets (2.1) and a plurality of transverse sheets (2.2) that are evenly distributed and joined together in the form of cross bars, and with a plurality of holes (2.3) distributed along the sheets (2.1, 2.2);

wherein both the panel-shaped base part and the stiffening part (1 and 2) are made of fibre-reinforced polymer (FRP) material, and wherein the stiffening part (2), in an operational position, is connected by resting on the panel-shaped base part (1) and fitting into the corresponding plurality of longitudinal and transverse channels (1.1, 1.2), defining a cavity in the plurality of longitudinal and transverse channels (1.1, 1.2) between both the panel-shaped base part and the stiffening part (1, 2) to be filled with fibre-reinforced concrete through the plurality of holes (2.3), forming a monolithic assembly once the concrete has set, and both the panel-shaped base part and the stiffening part (1.1, 1.2) are configured to form a self-supporting structure that is reinforced and becomes stiffer when a subsequently poured concrete is set.

2. The structural system according to claim 1, wherein the plurality of longitudinal channels (1.1, 1.2) of the base part (1) are V-shaped and have a cross-section in an upper part thereof configured to fit the stiffening part (2) with pins (2.4) having complementary geometry of the sheets (2.1, 2.2) of said stiffening part (2).

3. The structural system according to claim 1, wherein the stiffening part (2) and the panel-shaped base part (1) are connected by means of mechanical and/or adhesive fastening means.

4. The structural system according to claim 1, wherein the panel-shaped base part (1) and/or the stiffening part (2) is manufactured by moulding as a monolithic part.

5. The structural system according to claim 1, wherein the panel-shaped base part (1) and the stiffening part (2) are manufactured in one piece.

6. The structural system according to claim 1, wherein the holes (2.3) of the stiffening part (2) are rounded, preferably circumferences.

7. The structural system according to claim 1, wherein the base part (1) comprises clip-on anchoring means (3) for fastening between side ends of the panel-shaped base part (1) and side ends of an adjacent base part (1').

8. The structural system according to claim 1, comprising fastening means (4) for joining the stiffening part (2) to an adjacent stiffening part (2') such that said fastening means (4) are fastened in the holes (2.3) in both the stiffening part and the adjacent stiffening part (2, 2'), and/or comprising fastening braces (5) that can be fastened between both adjacent stiffening parts (2, 2') which are fastened in corresponding holes (2.3).

9. The structural system according to claim 1, wherein the panel-shaped base part and the stiffening part (1, 2) have a configuration with a predefined shape depending on the construction for which they are intended.

10. The structural system according to claim 1, comprising a primer or roughness on the base part (1) for better adhesion of concrete.

11. The structural system according to claim 1, comprising moulds for the manufacture of the base part (1).

12. A building method comprising:

arranging an enclosure as a foundation mould comprising an inner part in FRP (6.1), and a central prismatic element (6.4) for connecting a pillar (7) of the building to be built, and filling with fibre-reinforced concrete (6.3) to form each of the foundation elements (6), constructing a slab according to the following steps:

arranging a capital (11) on pillars made of FRP with openings at the bottom thereof in the connection area with the pillars (7) for the passage of concrete, and then proceeding with the joint concreting of the girder (8) and pillar (7) with fibre-reinforced concrete, placing the two-way structural system in the form of a plate (8 and 10) between capitals and covering the entire surface according to claim 1, and after fastening perimeter closing slab girders (9) to the plates, pouring fibre-reinforced concrete to form the final slab, repeating the slab construction process according to the number of floors in the building.

13. A method for constructing bridges, comprising arranging the structural system according to claim 9, with flat modules (13) and/or curved modules (12) suitable for the shape of the bridge (14) to be built, and joining said modules (12, 13) with fastening means (4) and anchoring means (3) and/or fastening braces (5), so that a main flat module (13.1) of the structural system is joined at the starting points of curvature of the bridge (14), placing the necessary additional reinforcements and subsequently pouring the fibre concrete until it sets, forming the integral assembly of a bridge (14).

14. A method for constructing tunnels and underground works, comprising arranging the structural system according to claim 9, with modules (18) having a geometry of constant curvature, variable curvature or a polygonal succession which, after connection thereof by fastening means (3) and anchoring means (5), form a geometric configuration of variable curvature or polygonal sequence, placing the necessary additional reinforcements and subsequently pouring the fibre concrete until it sets, forming the integral assembly of a tunnel (15) or underground work.

* * * * *